US010640893B2

(12) United States Patent
Sarzotti et al.

(10) Patent No.: US 10,640,893 B2
(45) Date of Patent: May 5, 2020

(54) FLAME RETARDANT FIBERS, YARNS, AND FABRICS MADE THEREFROM

(75) Inventors: Deborah M. Sarzotti, Kingston (CA); Thomas E. Schmitt, Concord, NC (US); Andrew W. Briggs, Kingston (CA)

(73) Assignee: INVISTA North America S.a.r.l., Wilmington, DE (US)

( * ) Notice: Subject to any disclaimer, the term of this patent is extended or adjusted under 35 U.S.C. 154(b) by 823 days.

(21) Appl. No.: 13/825,209

(22) PCT Filed: Sep. 21, 2011

(86) PCT No.: PCT/US2011/052557

§ 371 (c)(1), (2), (4) Date: May 22, 2013

(87) PCT Pub. No.: WO2012/040332

PCT Pub. Date: Mar. 29, 2012

(65) Prior Publication Data

US 2013/0244527 A1 Sep. 19, 2013

Related U.S. Application Data

(60) Provisional application No. 61/385,614, filed on Sep. 23, 2010.

(51) Int. Cl.
*D02G 3/44* (2006.01)
*D01F 6/60* (2006.01)
(Continued)

(52) U.S. Cl.
CPC ..... *D02G 3/443* (2013.01); *D01F 1/07* (2013.01); *D01F 6/605* (2013.01); *D04H 1/42* (2013.01);
(Continued)

(58) Field of Classification Search
CPC ..... Y10T 442/696; Y10T 442/68; D02G 3/44
(Continued)

(56) References Cited

U.S. PATENT DOCUMENTS 4,970,255 A 11/1990 Reimann et al.
5,356,700 A * 10/1994 Tanaka ..... D02G 3/047 139/420 R
(Continued)

FOREIGN PATENT DOCUMENTS

CA 2078626 C 4/1999
CN 1201474 A 12/1998
(Continued)

OTHER PUBLICATIONS

Deopura, B.L., Alagirusamy, R., Joshi, M. and Gupta, B., Polyesters and Polyamides, 2008, p. 320, Woodhead Publishing Limited, Cambridge.
(Continued)

*Primary Examiner* — Peter Y Choi
(74) *Attorney, Agent, or Firm* — Invista North America S.a.r.l.

(57) ABSTRACT

Disclosed are technical fibers and yarns made with partially aromatic polyamides and non-halogenated flame retardant additives. Fabrics made from such fibers and yarns demonstrate superior flame retardancy over traditional flame retardant nylon 6,6 fabrics. Further, the disclosed fibers and yarns, when blended with other flame retardant fibers, do not demonstrate the dangerous "scaffolding effect" common with flame retardant nylon 6,6 blended fabrics.

13 Claims, 5 Drawing Sheets

(51) Int. Cl.

| | |
|---|---|
| ***D01F 1/07*** | (2006.01) |
| ***D04H 1/4342*** | (2012.01) |
| ***D04H 1/4382*** | (2012.01) |
| ***D04H 1/42*** | (2012.01) |

(52) U.S. Cl.
CPC ..... *D04H 1/4342* (2013.01); *D04H 1/4382* (2013.01); *D10B 2331/021* (2013.01); *Y10T 428/249921* (2015.04); *Y10T 428/2904* (2015.01); *Y10T 442/68* (2015.04); *Y10T 442/681* (2015.04); *Y10T 442/696* (2015.04)

(58) Field of Classification Search
USPC ..... 442/302, 414, 301
See application file for complete search history.

(56) References Cited

U.S. PATENT DOCUMENTS

| | | | | |
|---|---|---|---|---|
| 6,184,282 | B1 | 2/2001 | Gareiss et al. | |
| 6,225,383 | B1 * | 5/2001 | Hirono | C08K 5/34928 524/100 |
| 6,255,371 | B1 * | 7/2001 | Schlosser | C08K 5/34928 252/609 |
| 6,342,548 | B2 * | 1/2002 | Flippo | C08K 5/3492 524/100 |
| 2004/0076824 | A1 * | 4/2004 | Urabe | D01F 1/07 428/375 |
| 2006/0266986 | A1 * | 11/2006 | Day | D01F 1/07 252/608 |
| 2007/0148455 | A1 | 6/2007 | Ke | |
| 2008/0057807 | A1 * | 3/2008 | Tutterow | A41D 31/0022 442/1 |

FOREIGN PATENT DOCUMENTS

| | | | |
|---|---|---|---|
| CN | 1950455 | A | 4/2007 |
| CN | 101166852 | A | 4/2008 |
| CN | 101611182 | A | 12/2009 |
| CN | 101754998 | A | 6/2010 |
| EP | 0559128 | | 9/1993 |
| EP | 2096199 | | 9/2009 |
| JP | H02-127466 | A | 5/1990 |
| JP | 2703390 | B2 | 1/1998 |
| JP | H10-280230 | A | 10/1998 |
| JP | 2000303257 | | 10/2000 |
| JP | 2000-328363 | A | 11/2000 |
| JP | 2001234066 | A | 8/2001 |
| JP | 2003-105659 | A | 4/2003 |
| JP | 2007-500803 | A | 1/2007 |
| KR | 93-9831 | B1 | 10/1993 |
| TW | 200538499 | A | 12/2005 |
| TW | 200613448 | A | 5/2006 |
| TW | 200617097 | A | 6/2006 |
| WO | 2005095685 | A1 | 10/2005 |
| WO | 2009/101930 | A1 | 8/2009 |

OTHER PUBLICATIONS

Horrocks, Richard A., Price, Dennis. Fire Retardant Materials, 148 § 4.5.2, 2001, CRC Press, Boca Raton.

"Fabric Flame Retardant Treatment", Cotton, Incorporated. Cary, NC (2003).

International Preliminary Report on Patentability received for PCT Patent Application No. PCT/US2011/052557 dated Apr. 4, 2013, 6 pages.

International Search Report received for PCT Patent Application No. PCT/US2011/052557 dated May 2, 2012, 3 pages.

Written Opinion received for PCT Patent Application No. PCT/US2011/052557 dated May 2, 2012 , 4 pages.

* cited by examiner

50/50 10% MPP in nylon-6,6/FR rayon

50/50 10% MPP in MXD6/FR rayon

50/50 10% DEPAI in nylon-6,6/FR rayon

50/50 10% DEPAI in MXD6/FR rayon

DEPZn: Diethyl phosphinate, zinc salt

DEPAl: Diethyl phosphinate, aluminum salt

MC: Melamine cyanurate

SiTA: Silicotungstic acid

FLAME RETARDANT FIBERS, YARNS, AND FABRICS MADE THEREFROM

FIELD OF THE INVENTION

The invention relates to technical fibers, yarns, and fabrics in general, and in particular, to flame retardant fibers, yarns, and fabrics made therefrom comprising partially aromatic polyamides and non-halogenated flame retardant additives.

BACKGROUND OF THE TECHNOLOGY

Flame retardant (FR) fabrics are crucial in both military and non-military environments. Firefighters, race car drivers, and petro-chemical workers are just a few of the non-military groups that benefit from the added protection of flame retardant fabrics. However, the true benefit of flame retardant fabrics lies with the military. In addition to the unforgiving surroundings that our military troops must operate in, the advent of unconventional modern warfare creates an even more hostile environment. Specifically, the use of improvised explosive devices ("IEDs") to immobilize large convoys of soldiers makes individual troop protection critically important.

In addition to ballistic fabrics and body armor, flame retardant fabrics serve a crucial role in protecting soldiers from IEDs. IEDs are constructed of numerous materials (e.g. high-explosive charges, flammable liquids, shrapnel, etc.), some acting as projectiles and others acting as incendiaries upon detonation. Thus, military fabrics must be of varied construction to handle the multitude of threats from an IED.

There are basically two types of flame retardant fabrics used in protective clothing: (1) Fabrics made from flame retardant organic fibers (e.g. aramid, flame retardant rayon, polybenzimidazole, modacrylic, etc.); and (2) Flame retardant fabrics made from conventional materials (e.g. cotton) that have been post treated to impart flame-retardancy. Nomex® and Kevlar® aromatic polyamides are among the most common types of flame retardant synthetic fibers. These are made by solution spinning a meta- or para-aromatic polyamide polymer into fiber. Aromatic polyamides do not melt under extreme heat, are naturally flame retardant, but must be solution spun. Unfortunately, Nomex® is not very comfortable and it is difficult and expensive to produce. Kevlar® is also difficult and expensive to produce.

Post-treatment flame retardants are applied to fabrics and can be broken down into two basic categories: (1) Durable flame retardants; and (2) Non-durable flame retardants. For protective clothing, the treatment must withstand laundering, so only durable treatments are selected. Today, most often, durable flame retardant chemistry relies on phosphorus-based FR agents and chemicals or resins to fix the FR agents on the fabric.

One polymer fiber that has been widely studied because of its processability and strength is nylon 6,6 fiber. A small amount—about 12%—of aliphatic nylon fibers can be blended with cotton and chemically treated to produce a flame retardant fabric. Because cotton is the major fiber component, this fabric is called "FR cotton" fabric. Nylon fibers impart superior wear resistance to FR cotton fabrics and garments. However, because nylon is melt processable (i.e. thermoplastic) and offers no inherent flame resistance, the quantity of nylon fiber in an FR fabric is limited. Attempts to chemically modify aliphatic nylon fibers and increase nylon fiber content, while still achieving adequate flame retardancy, have been unsuccessful. In fact, Deopura and Alagirusamy state in their recent book *Polyesters and Polyamides* (The Textile Institute 2008 at page 320) that "[i]t seems unlikely that there will be any major breakthroughs with regard to new and/or improved reactive flame-retardant comonomers or conventional . . . flame retardant additives for use in . . . nylon fibers."

SUMMARY OF THE INVENTION

The problem with using blends of thermoplastic fibers with non-melting flame resistant fibers (e.g. aliphatic polyamides and FR treated cotton) is the so-called "scaffolding effect." (See Horrocks et al., *Fire Retardant Materials* at 148, § 4.5.2 (2001)). In general, thermoplastic fibers, including those treated or modified with FR agents, self-extinguish by shrinking away from the flame source or when molten polymer drips away from the flame source and extinguishes. FR polyester fiber is a fiber with such behavior. When FR polyester fiber is blended with a non-melting flame retardant fiber, such as FR-treated cotton, the non-melting fiber forms a carbonaceous scaffold (the "scaffolding effect") and the thermoplastic FR polyester fiber is constrained in the flame and will continue to burn. In essence, during vertical flammability testing, the thermoplastic fiber polymer melts and runs down the non-thermoplastic scrim and feeds the flame and the fabric burns completely. Additionally, in clothing, the molten polymer can drip and stick to human skin and results in additional injuries to the wearer.

What is needed is improved flame retardant nylon blends that eliminate the "scaffolding effect", provide good flame retardancy, prevent dripping and sticking, and are wear resistant. Therefore, it is desirable to find a combination of melt-processed polymer that can be blended with flame retardant additives into a fiber that can be knit or woven or prepared into a nonwoven a self-extinguishing, no drip, wear resistant/durable flame retardant fabric, batting or garment.

The invention disclosed herein provides a flame retardant fabric made from a melt processed polyamide and a non-halogen flame retardant additive. Surprisingly, it was found that partially aromatic polyamides, when blended with flame retardant additives, are melt processable into fibers that exhibit superior flame retardancy over aliphatic polyamides (e.g. nylon 6,6) when blended with the same flame retardants. This is unexpected because partially aromatic polyamides are thermoplastic (i.e. melt upon heating), which are associated with the "scaffolding effect" and poor flame retardancy.

In one aspect, a flame retardant fiber is disclosed comprising a partially aromatic polyamide and a non-halogen flame retardant. The partially aromatic polyamide can comprise aromatic diamine monomers and aliphatic diacid monomers. Also, the partially aromatic polyamide can comprise polymers or copolymers of aromatic and aliphatic diamines and diacids, including MXD6. For example, MXD6 refers to polyamides produced from m-xylenediamine (MXDA) and adipic acid.

In another aspect, flame retardant yarns and fabrics made with the disclosed flame retardant fibers are disclosed. The yarns can also comprise additional fibers, either natural or synthetic, including continuous filament and staple fibers. The additional fibers can be inherently flame retarding or treated with flame retardants. The fabrics can also comprise additional yarns, either natural, synthetic, or a blend of both. The additional yarns can be treated with flame retardants or contain fibers treated with flame retardants. The fabrics can be dyed and also have additional finishes applied, both flame retardant and non-flame retardant.

DETAILED DESCRIPTION OF THE INVENTION

Figure 1A:
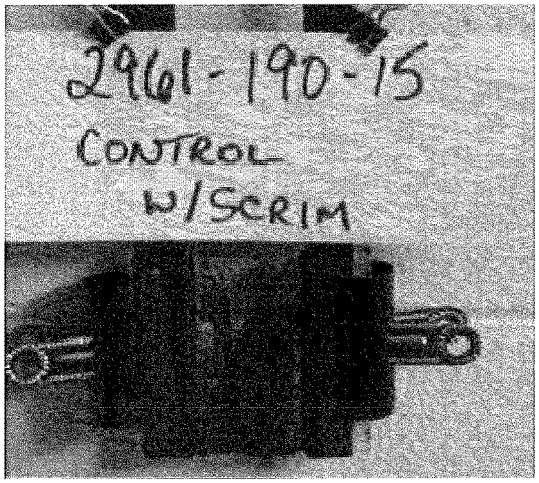
FIGS. 1*a*-1*h* show the flame retardance of various aspects of the disclosed flame retardant polymer and conventional nylon 6,6 flame retardant polymers.
Figure 1B:
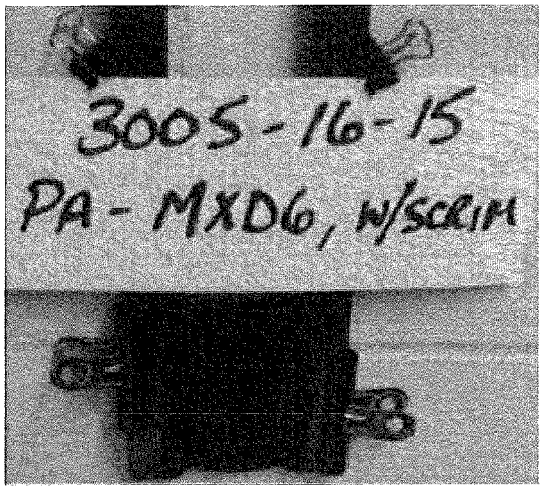
Figure 1C:
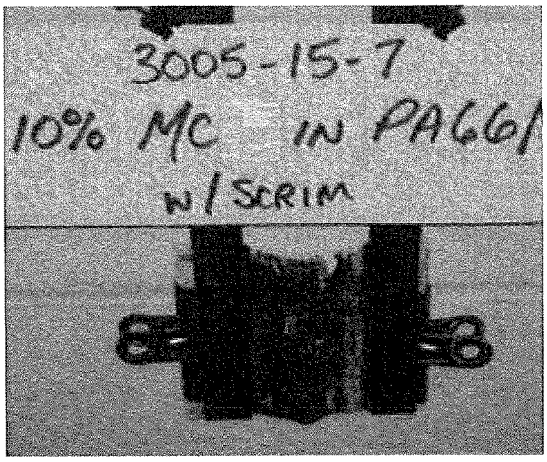
Figure 1D:
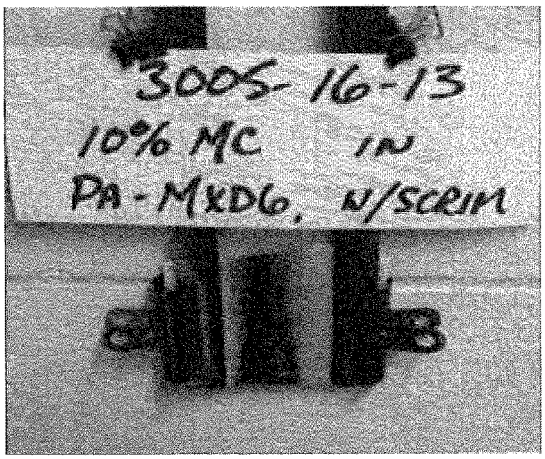
Figure 1E:
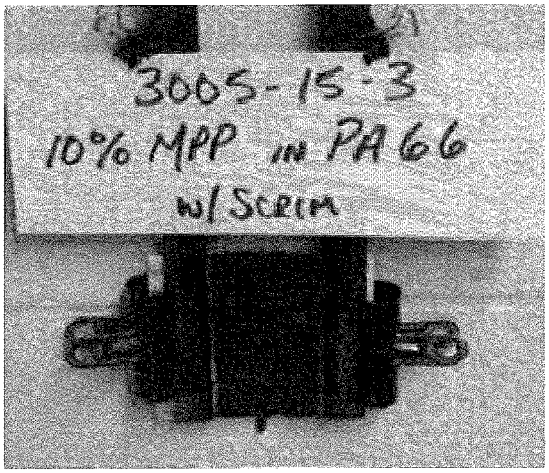
Figure 1F:
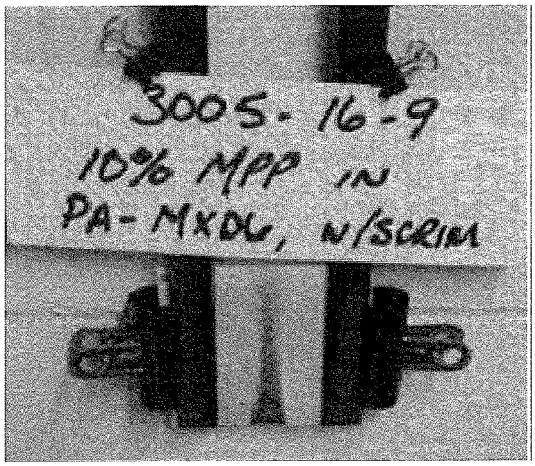
Figure 1G:
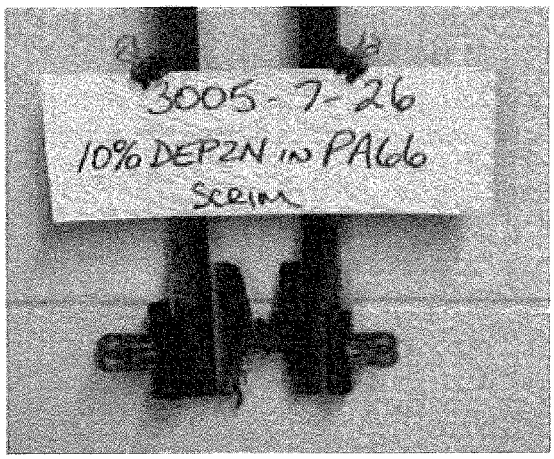
Figure 1H:
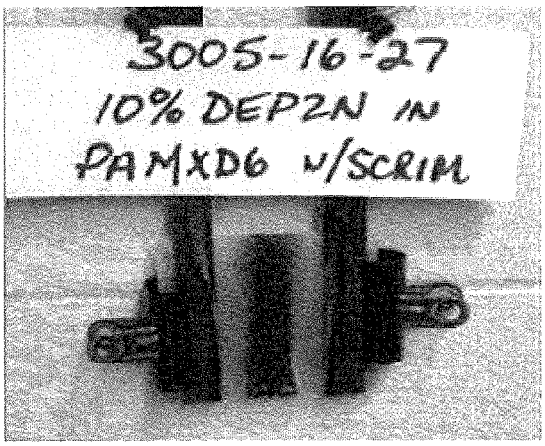

The terms "flame resistant," "flame retardant," and "FR" have subtle differences in the art. The differences in the usage of the terms relate to describing fabrics which either resist burning, burn at a slower rate and are capable of self-extinguishing under conditions such as a vertical flame test. For the purposes of this invention the terms "flame resistant" and "flame retardant" are used interchangeably and are meant to include any fabric that possesses one or more of the desired properties such as resistance to burning, slow burning, self-extinguishing, etc.

A flame retardant fiber is disclosed comprising a partially aromatic polyamide and a non-halogen flame retardant additive. The partially aromatic polyamide may include polymers or copolymers including monomers selected from the group consisting of aromatic diamine monomers, aliphatic diamine monomers, aromatic diacid monomers, aliphatic diacid monomers and combinations thereof. The partially aromatic polyamide can also include or exclusively be MXD6 which includes an aromatic diamine and non-aromatic diacid. Other partially aromatic polyamides can be based upon an aromatic diacid such as terephthalic acid (polyamide 6T) or isophthalic acid (polyamide 6I) or blends thereof (polyamide 6T/6I). The melting, or processing temperatures, of partially aromatic polyamides ranges from about 240° C. (for MXD6) to about 355° C. (for polyamideimide), including about 260° C., 280° C., 300° C., 320° C., and 340° C. Nylon 6 and nylon 6,6 have melting temperatures of about 220° C. and 260° C., respectively. The lower the melting temperature, the easier the polyamide polymer is to process into fiber. Below is a list of common partially aromatic polymers and certain comparative non-aromatics and their associated melting temperatures.

| Polymer | Trade Name | Melting Temperature, ° C. |
|---|---|---|
| Nylon 6 (non-aromatic) | Various | 220 |
| Nylon 66 (non-aromatic) | Various | 260 |
| MXD6 | MXD6 | 240 |
| Nylon 6/6T | Grivory | 295 |
| Polyphthalamide (PPA) | Zytel, LNP | 300 |
| Nylon 6T | Arlen | 310 |
| Nylon 6I/6T | Grivory | 325 |
| Polyamideimide | Torlon | 355 |

The partially aromatic polyamides may also include copolymers or mixtures of multiple partially aromatic amides. For example, MXD6 can be blended with Nylon 6/6T prior to forming a fiber. Furthermore, partially aromatic polymers may be blended with an aliphatic polyamide or co-polymers or mixtures of multiple aliphatic polyamides. For example, MXD6 can be blended with Nylon 6,6 prior to forming a fiber.

The non-halogen flame retardant additives can include: condensation products of melamine (including melam, melem, and melon), reaction products of melamine with phosphoric acid (including melamine phosphate, melamine pyrophosphate, and melamine polyphosphate (MPP)), reaction products of condensation products of melamine with phosphoric acid (including melam polyphosphate, melem polyphosphate, melon polyphosphate), melamine cyanurate (MC), zinc diethylphosphinate (DEPZn), aluminum diethylphosphinate (DEPAI), calcium diethylphosphinate, magnesium diethylphosphinate, bisphenol-A bis(diphenyphosphinate) (BPADP), resorcinol bis(2,6-dixylenyl phosphate) (RDX), resorcinol bis(diphenyl phosphate) (RDP), phosphorous oxynitride, zinc borate, zinc oxide, zinc stannate, zinc hydroxystannate, zinc sulfide, zinc phosphate, zinc silicate, zinc hydroxide, zinc carbonate, zinc stearate, magnesium stearate, ammonium octamolybdate, melamine molybdate, melamine octamolybdate, barium metaborate, ferrocene, boron phosphate, boron borate, magnesium hydroxide, magnesium borate, aluminum hydroxide, alumina trihydrate, melamine salts of glycoluril and 3-amino-1,2,4-triazole-5-thiol, urazole salts of potassium, zinc and iron, 1,2-ethanediyl-4-4'-bis-triazolidine-3,5,dione, silicone, oxides of Mg, Al, Ti, Cr, Mn, Fe, Co, Ni, Cu, Zn, Zr, Mo, Sn, Sb, Ba, W, and Bi, polyhedral oligomeric silsesquioxanes, silicotungstic acid (SiTA), phosphotungstic acid, melamine salts of tungstic acid, linear, branched or cyclic phosphates or phosphonates, spirobisphosphonates, spirobisphosphates and nanoparticles, such as carbon nanotubes and nanoclays (including, but not limited to, those based on montmorillonite, halloysite, and laponite).

The flame retardant additive is present in an amount from about 1% to about 25% w/w, including from about 5% to about 20% w/w, about 5% to about 10%, and about 10%. The mean particle size of the flame retardant additive is less than about 3 microns, including less than about 2 microns, and less than about 1 micron.

The particle size of the flame retardant additive may be prepared by a milling process which comprises air jet milling of each component, or of co-milling blends of components to reduce the particle size. Other wet or dry milling techniques known in the art (e.g. media milling) may also be used to reduce additive particle size for fiber spinning. If appropriate, milling may involve the injection of liquid milling aids, possibly under pressure, into the mill at any suitable point in the milling process. These liquid aids are added to stabilize the flame retardant system and/or prevent agglomeration. Additional components to aid in particle wetting and/or prevent re-agglomeration may also be added at any suitable point during the milling of flame retardant additive, the blending of the flame retardant additive and polymer, and/or the fiber spinning process.

The flame retardant may be compounded with the polymeric material in an extruder. An alternative method involves dispersing the flame retardant composition in polymer at a higher concentration than desired in the final polyamide fiber product, and forming a masterbatch. The masterbatch may be ground or pelletized and the resulting particulate dry-blended with additional polyamide resin and this blend used in the fiber spinning process. Yet another alternative method involves adding some or all components of the flame retardant additive to the polymer at a suitable point in the polymerization process.

The flame retardant fiber can be a staple fiber or continuous filament. The flame retardant fiber can also be contained in a nonwoven fabric such as spun bond, melt blown, or combination thereof, fabric. The filament cross section can be any shape, including round, triangle, star, square, oval, bilobal, tri-lobal, or flat. Further, the filament can be textured using known texturing methods. As discussed above, the partially aromatic polyamides spun into fibers can also include additional partially aromatic or aliphatic polymers. When spinning such fibers, a mixture of more than one polyamide polymer may be blended prior to spinning into yarn or a multi-filament yarn may be produced containing at least one partially aromatic polyamide polymer and an additional partially aromatic polyamide polymer or aliphatic polymer in a bicomponent form such as a side-by-side or core-sheath configuration.

The flame retardant staple fiber can be spun into a flame retardant yarn. The yarn can comprise 100% flame retardant fiber, or can be a blend with additional staple fibers, both flame retardant and non-flame retardant, to make a staple spun yarn. The additional fibers can include cotton, wool, flax, hemp, silk, nylon, lyocell, polyester, and rayon. The staple spun yarn above can also comprise other thermoplastic or non-thermoplastic fibers, such as cellulose, aramids, novoloid, phenolic, polyesters, oxidized acrylic, modacrylic, melamine, poly(p-phenylene benzobisoxazole) (PBO), polybenzimidazole (PBI), or polysulphonamide (PSA), oxidized polyacrylonitrile (PAN), such as partially oxidized PAN, and blends thereof. As used herein, cellulose includes cotton, rayon, and lyocell. The thermoplastic/non-thermoplastic fibers can be flame retardant. Certain fibers, such as aramid, PBI, or PBO, maintain strength after flame exposure and, when used in blended yarns and fabrics, are effective at reducing the fabric char length after flammability testing.

Fabrics comprising the flame retardant yarn made with the disclosed flame retardant fiber will self extinguish in textile vertical flammability tests (ASTM D6413). The self extinguishing behavior is achieved in fabrics made with 100% of the disclosed flame retardant fiber or in blends of the flame retardant fiber and staple spun fibers as disclosed above. The fabrics made with the disclosed flame retardant yarn can also include additional yarns, such as cellulose, aramids, phenolic, polyester, oxidized acrylic, modacrylic, melamine, cotton, silk, flax, hemp, wool, rayon, lyocell, poly(p-phenylene benzobisoxazole) (PBO), polybenzimidazole (PBI), and polysulphonamide (PSA) fibers, partially oxidized acrylic (including partially oxidized polyacrylonitrile), novoloid, wool, flax, hemp, silk, nylon (whether FR or not), polyester (whether FR or not), anti-static fibers, and combinations thereof. The fabric can be treated with additional flame retardant additives and finishes if necessary. An exemplary method for treating cotton is found in the technical bulletin 'Fabric Flame Retardant Treatment' (2003) published by Cotton Incorporated, Cary, N.C., herein incorporated by reference in its entirety. The fabrics can be woven, knit, and non-woven fabrics. Non-woven fabrics include those made from carded webs, wet-lay, or spunbond/melt blown processes.

The fibers, yarns, and fabrics can also contain additional components such as: UV stabilizers, anti-microbial agents, bleaching agents, optical brighteners, anti-oxidants, pigments, dyes, soil repellants, stain repellants, nanoparticles, and water repellants. UV stabilizers, anti-microbials agents, optical brighteners, anti-oxidants, nanoparticles, and pigments can be added to the flame retardant fiber prior to melt-spinning or added as a post-treatment after fiber formation. Dyes, soil repellants, stain repellants, nanoparticles and water repellants can be added as a post-treatment after fiber and/or fabric formation. For yarns and fabrics, the additional component can be added as a post treatment. Fabrics made with the disclosed flame retardant fiber may also have a coating or laminated film applied for abrasion resistance or for control of liquid/vapor permeation.

Figure 2:
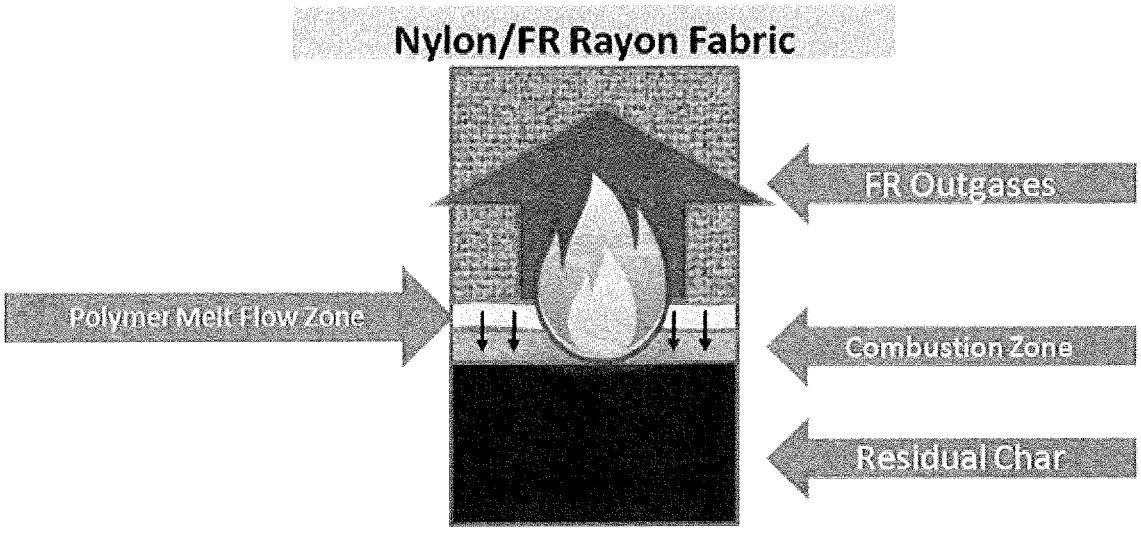
FIG. 2 shows the Scaffolding Effect problem.
Figure 3A:
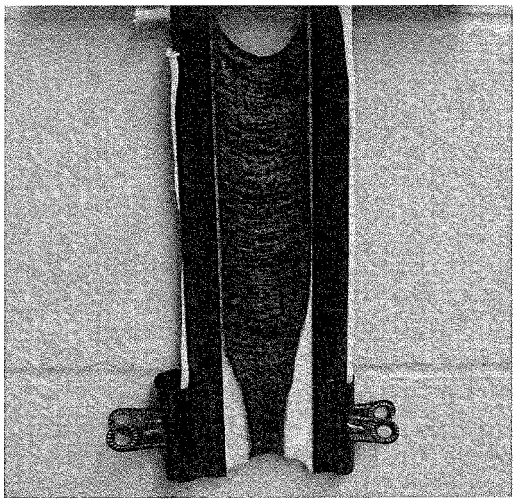
FIGS. 3*a*-3*d* show the flame retardancy of two aspects of the disclosed fabric when blended with flame retardant rayon, and nylon 6,6 flame retardant blended with flame retardant rayon.
Figure 3B:
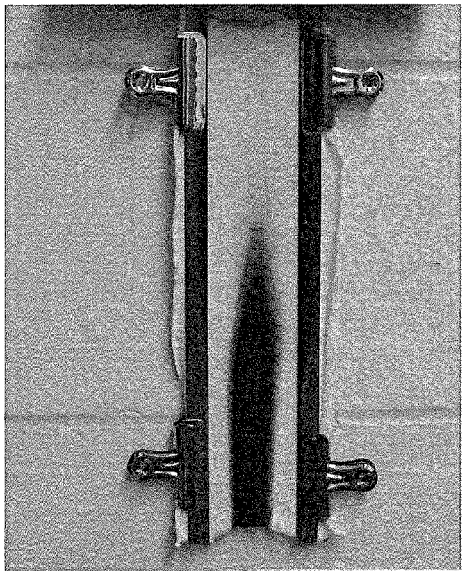
Figure 3C:
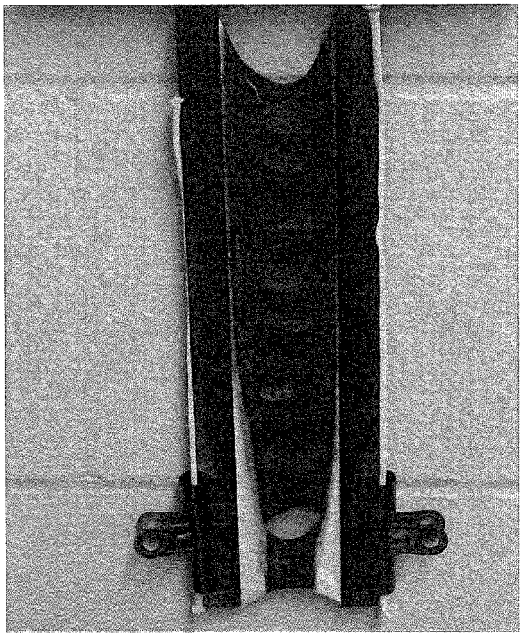
Figure 3D:
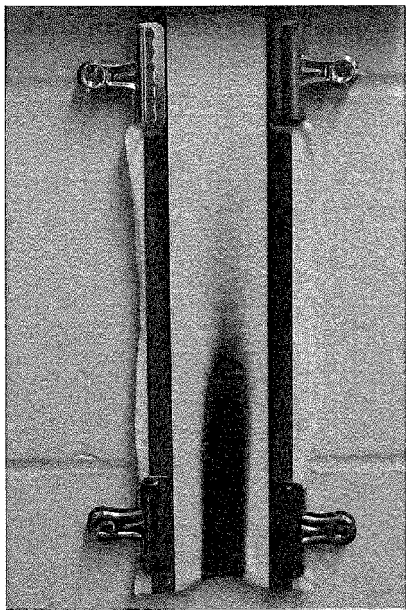
Figure 4:
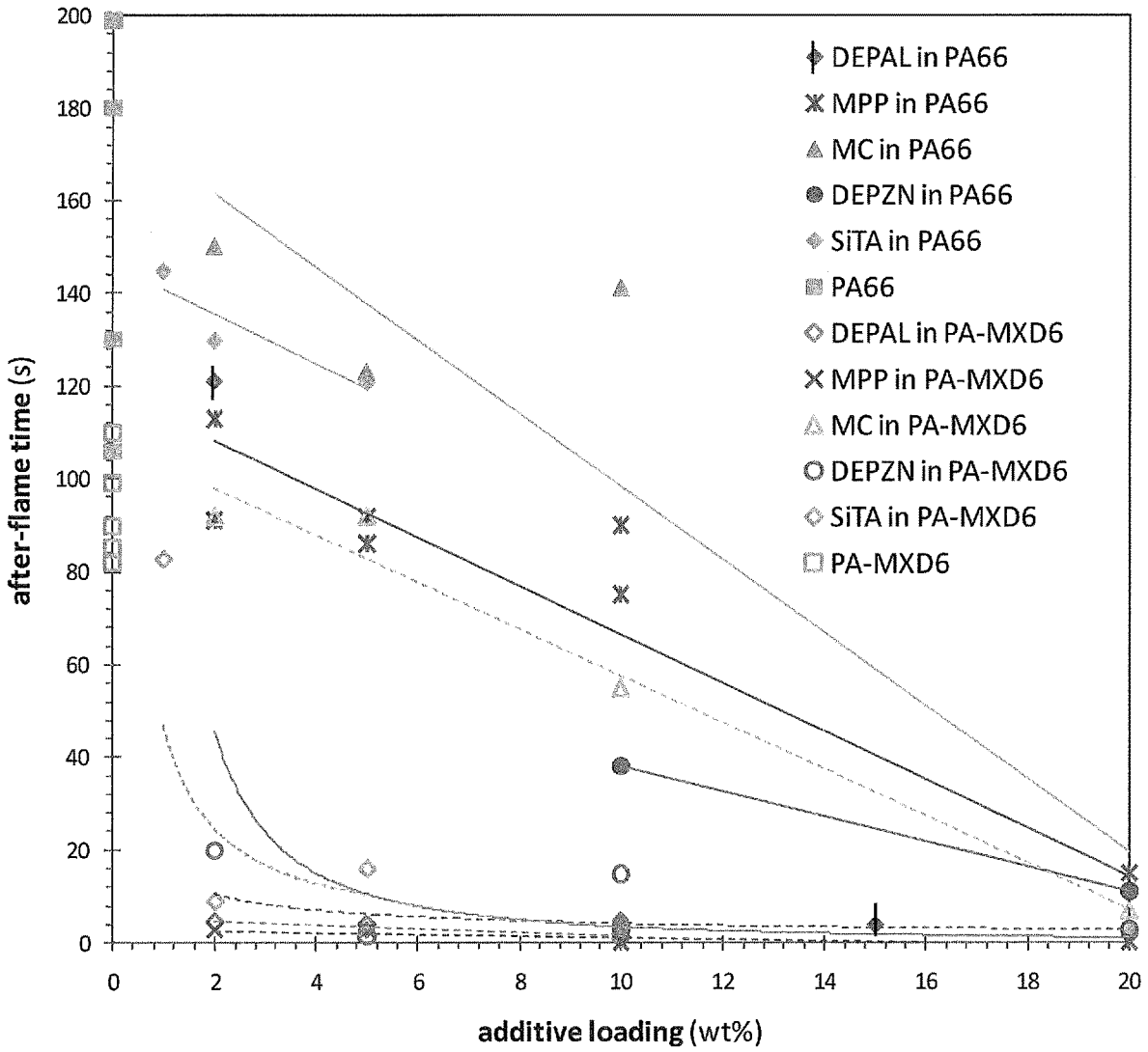
FIG. 4 compares the After-flame time of MXD6 versus nylon 6,6 with a variety of additives.

As shown in FIGS. 1*a*-1*h*, molded laminates made with the disclosed flame retardant polymer show superior flame retardancy (as measured using ASTM D-6413) compared to molded laminates made with conventional nylon 6,6 flame retardant fibers FIG. 2 is a schematic illustration of the Scaffolding Effect associated with flame retardant thermoplastics and non-thermoplastic fibers. FIGS. 3*a*-3*d* compare fabrics made with the disclosed flame retardant fiber and flame retardant rayon to fabrics made with nylon 6,6 flame retardant fibers and flame retardant rayon. Here, the fabrics made with the disclosed flame retardant fibers (FIGS. 3*b*-3*d*) do not suffer from the scaffolding problem, while the nylon 6,6 fabric (FIGS. 3*a* and 3*c*) does. FIG. 4 shows the vertical flammability data for nylon 6,6 and MXD6 polymers with various flame retardant additives at various concentrations. The figure shows the unexpected advantage with MXD6 over nylon 6,6.

Definitions

After flame means: "Persistent flaming of a material after ignition source has been removed." [Source: ATSM D6413 *Standard test Method for Flame Resistance of Textiles* (*Vertical Method*)]

Char length means: "The distance from the fabric edge, which is directly exposed to flame to the furthest of visible fabric damage, after a specified tearing force has been applied." [Source: ATSM D6413 *Standard test Method for Flame Resistance of Textiles* (*Vertical Method*)]

Drip means: "A flow of liquid that lacks sufficient quantity or pressure to form a continuous stream." [Source: National Fire Protection Association (NFPA) Standard 2112, *Standard on Flame-Resistant Garments for Protection of Industrial Personnel Against Flash Fire*].

Melt means: The response to heat by a material resulting in evidence of flowing or dripping.' [Source: National Fire Protection Association (NFPA) Standard 2112, *Standard on Flame-Resistant Garments for Protection of Industrial Personnel Against Flash Fire*].

Self Extinguishing means: Material will have no persistent flaming after the ignition source is removed OR flaming shall stop before the specimen is totally consumed. When tested by ATSM D6413 *Standard test Method for Flame Resistance of Textiles* (*Vertical Method*).

Test Methods:

Flame retardancy was determined in accordance with ASTM D-6413 *Standard Test Method for Flame Resistance of Textiles* (*Vertical Test*).

Preparation of Compression Molded Laminates: Polymers with or without an FR additive are compression molded into films with dimensions of approximately 10 cm×10 cm and weighing approximately 10 grams. Before molding, woven glass fiber scrims are placed above and below the polymer mixture. The glass fiber scrims prevent polymer shrinking or melting away from the flame during vertical flammability testing and can predict the potential existence of the "scaffolding effect." The weight of the scrims is about 7% of the final laminate. The molding temperature is approximately 25 degrees Celsius above the melting temperature of the polymer.

EXAMPLES

Examples 1-7

Flame Retardancy of Molded Laminates Made with Various Aspects of the Disclosed Flame Retardant Fiber Test laminates were prepared using the technique above. Example 1 is made with MXD6 and no flame retardant additive. Example 2 is made with MXD6 and 10% w/w MPP (melamine polyphosphate) additive. Example 3 is made with MXD6 and 10% w/w MC (melamine cyanurate) additive. Example 4 is made with MXD6 and 10% w/w DEPZn (zinc diethylphosphinate) additive. Example 5 is made with MXD6 and 10% w/w DEPAI (aluminum diethylphosphinate). Example 6 is made with MXD6 and 2% w/w SiTA (silicotungstic acid). Example 7 is made with MXD6 and 20% w/w MC additive. Results are reported in Table 1 below.

Comparative Examples 1-4

Flame Retardancy of Molded Laminates Made With Nylon 6,6 and Flame Retardant Additives Test laminates were prepared using the technique above. Comparative Example 1 is made with nylon 6,6 and no flame retardant additive. Comparative Example 2 is made with nylon 6,6 and 10% w/w MPP additive. Comparative Example 3 is made with nylon 6,6 and 10% w/w MC additive. Comparative Example 4 is made with nylon 6,6 and 10% w/w DEPZn additive. Comparative Example 5 is made with nylon 6,6 and no flame retardant additive. Results are reported in Table 1 below.

TABLE 1

Flame Retardancy Measurements

| | Polymer | Additive Weight % | After-flame sec | Drips | Self Extinguished | FIG. |
|---|---|---|---|---|---|---|
| Ex. 1 | MXD6 | None | 82 | No | No | 1b |
| Ex. 2 | MXD6 | 10% MPP | 0 | No | Yes | 1d |
| Ex. 3 | MXD6 | 10% MC | 55 | No | Yes | 1f |
| Ex. 4 | MXD6 | 10% DEPZn | 3 | No | Yes | 1h |
| Ex. 5 | MXD6 | 10% DEPAl | 2 | No | Yes | |
| Ex. 6 | MXD6 | 2% SiTA | 9 | No | Yes | |
| Ex. 7 | MXD6 | 20% MC | 7 | No | Yes | NA |
| Comp. Ex. 1 | Nylon 6,6 | None | 199 | Yes | No | 1a |
| Comp. Ex. 2 | Nylon 6,6 | 10% MPP | 75 | Yes | No | 1c |
| Comp. Ex. 3 | Nylon 6,6 | 10% MC | 141 | Yes | No | 1e |
| Comp. Ex. 4 | Nylon 6,6 | 10% DEPZn | 38 | Yes | No | 1g |
| Comp. Ex. 5 | Nylon 6,6 | 2% SiTA | 130 | Yes | No | |

As shown above in Table 1, the disclosed flame retardant laminates self extinguished and had shorter after flame time compared to the nylon 6,6 counterpart. Further, the disclosed flame retardant laminates also resulted in no flaming drips, a desired characteristic of any flame retardant fabric. Because both the MXD6 and nylon 6,6 based polymers are melt processable, the results with the MXD6 polymer above are surprising and unexpected.

Example 8-18

Flame Retardancy of Fabrics Made with the Disclosed Flame Retardant Fiber and Flame Retardant Rayon In the following examples, flame retarding thermoplastic yarns were combined with a staple spun FR rayon yarn (Lenzing FR) and knit into a tube fabric. The blended fabric contained approximately 50 percent of each yarn. Fiber finishes and knitting oils were removed from the fabrics before flammability testing.

Example 8 is a fabric blend of flame retardant MXD6 fiber containing 2% w/w MPP additive with flame retardant rayon fiber. Example 9 is a fabric blend of flame retardant MXD6 fiber containing 5% w/w MPP additive with flame retardant rayon fiber. Example 10 is a fabric blend of flame retardant MXD6 fiber containing 10% w/w MPP additive with flame retardant rayon fiber. Example 11 is a fabric blend of flame retardant MXD6 fiber containing 2% w/w DEPAI additive with flame retardant rayon fiber. Example 12 is a fabric blend of flame retardant MXD6 fiber containing 5% w/w DEPAI additive with flame retardant rayon fiber. Example 13 is a fabric blend of flame retardant MXD6 fiber containing 10% w/w DEPAI additive with flame retardant rayon fiber. Example 14 is a fabric blend of flame retardant MXD6 fiber containing 5% w/w DEPZn additive with flame retardant rayon fiber. Example 15 is a fabric blend of flame retardant MXD6 fiber containing 10% w/w DEPZn additive with flame retardant rayon fiber. Results are reported in Table 2 below.

Comparative Examples 6-8

Flame Retardancy of Fabrics Made with Nylon 6,6 Flame Retardant Fiber and Flame Retardant Rayon Comparative Example 6 is a fabric blend of flame retardant nylon 6,6 fiber containing 5% w/w MPP additive with flame retardant rayon fiber. Comparative Example 7 is a fabric blend of flame retardant nylon 6,6 fiber containing 10% w/w MPP additive with flame retardant rayon fiber. Comparative Example 8 is a fabric blend of flame retardant nylon 6,6 containing 10% w/w DEPAI additive with flame retardant rayon fiber. Results are reported in Table 2 below.

TABLE 2

Flame Retardancy Measurements

| Fabric | Yarn Blend | Additive Weight % [1] | After-flame, sec | Self Extin-guished | Figure |
|---|---|---|---|---|---|
| Ex. 8 | MXD6/FR rayon | 2% MPP | 4.5 | Yes | |
| Ex. 9 | MXD6/FR rayon | 5% MPP | 3.0 | Yes | NA |
| Ex. 10 | MXD6/FR rayon | 10% MPP | 0.8 | Yes | 3b |
| Ex. 11 | MXD6/FR rayon | 2% DEPAl | 4.7 | Yes | |
| Ex. 12 | MXD6/FR rayon | 5% DEPAl | 4.7 | Yes | |
| Ex. 13 | MXD6/FR rayon | 10% DEPAl | 3.8 | Yes | 3d |
| Ex. 14 | MXD6/FR rayon | 5% DEPZn | 16.6 | Yes | |
| Ex. 15 | MXD6/FR rayon | 10% DEPZn | 7.3 | Yes | |
| Comp. Ex. 6 | Nylon-6,6/FR rayon | 5% MPP | 24.8 | No | NA |
| Comp. Ex. 7 | Nylon-6,6/FR rayon | 10% MPP | 17.0 | No | 3a |

TABLE 2-continued

| Flame Retardancy Measurements | | | | | |
|---|---|---|---|---|---|
| Fabric | Yarn Blend | Additive Weight % [1] | After-flame, sec | Self Extin-guished | Figure |
| Comp. Ex. 8 | Nylon-6,6/FR rayon | 10% DEPAI | 33.3 | No | 3c |

[1] Percent based on thermoplastic polymer fiber.

Here, the blend of MXD6 and flame retardant rayon fibers showed superior results to the comparative blend of nylon 6,6 and flame retardant rayon fibers. As discussed above, these results are surprising and unexpected.

While the invention has been described in conjunction with specific aspects thereof, it is evident that the many alternatives, modifications, and variations will be apparent to those skilled in the art in light of the foregoing description. Accordingly, the invention is intended to embrace all such alternatives, modifications and variations that fall within the spirit and scope of the claims.

What is claimed is:

1. A flame retardant staple spun yarn comprising at least one flame retardant fiber comprising MXD6 compounded or dispersed with a non-halogen flame retardant additive prior to or during fiber extrusion, wherein the non-halogen flame retardant additives are present at a concentration of from about 5% to about 20% by weight of said fiber and are selected from the group consisting of melamine polyphosphate (MPP), zinc diethylphosphinate (DEPZn), aluminum diethylphosphinate (DEPAI), silicotungstic acid (SiTA), melamine cyanurate (MC) and combinations thereof; said fiber having fabric properties of wear-resistance and durability when formed into a fabric, batting or garment, is self extinguishing in a vertical flammability test ASTM D6413; and an additional fiber.

2. The flame retardant staple spun yarn of claim 1, wherein said additional fiber is selected from the group consisting of: cellulose, aramids, phenolic, polyester, oxidized acrylic, modacrylic, melamine, silk, flax, hemp, wool, poly(p-phenylene benzobisoxazole) (PBO), polybenzimidazole (PBI), andpolysulphonamide (PSA) fibers.

3. The flame retardant staple spun yarn of claim 1, wherein said additional fiber has been treated with a flame retardant.

4. The flame retardant staple spun yarn of claim 1, wherein said additional fiber is cotton, rayon, polyester, or lyocell.

5. A flame retardant continuous filament yam comprising at least one flame retardant fiber comprising MXD6 compounded or dispersed with a non-halogen flame retardant additive prior to or during fiber extrusion, wherein the non-halogen flame retardant additives are present at a concentration of from about 5% to about 20% by weight of said fiber and are selected from the group consisting of melamine polyphosphate (MPP), zinc diethylphosphinate (DEPZn), aluminum diethylphosphinate (DEPAI), silicotungstic acid (SiTA), melamine cyanurate (MC) and combinations thereof; said fiber having fabric properties of wear-resistance and durability when formed into a fabric, batting or garment, is self extinguishing in a vertical flammability test ASTM D6413, wherein said flame retardant fiber is continuous; and an additional continuous filament fiber.

6. The flame retardant continuous filament yarn of claim 5, wherein said additional continuous filament fiber is selected from the group consisting of: aramids, phenolic, polyesters, oxidized acrylic, modacrylic, melamine, lyocell, poly(p-phenylene benzobisoxazole) (PBO), polybenzimidazole (PBI), and polysulphonamide (PSA) fibers.

7. The flame retardant continuous filament yarn of claim 5 wherein said additional continuous filament fiber has been treated with a flame retardant.

8. A fabric comprising the yarn of claim 1 or claim 5.

9. The fabric of claim 8 further comprising an additional yarn.

10. The fabric of claim 9, wherein said additional yarn comprises a fiber selected from the group consisting of: cellulose, aramids, phenolic, polyester, oxidized acrylic, modacrylic, melamine, cotton, silk, flax, hemp, wool, rayon, lyocell, poly(p-phenylene benzobisoxazole) (PBO), polybenzimidazole (PBI), and polysulphonamide (PSA) fibers.

11. A nonwoven flame retardant fabric comprising the yarn of claim 1 or claim 5.

12. The nonwoven flame retardant fabric of claim 11, wherein said nonwoven is made by a process selected from the group consisting of: spun-bond, melt-blown and a combination thereof.

13. Protective clothing comprising yarn of claim 1 or claim 5.

* * * * *